US006012362A

United States Patent [19]

Wang

[11] Patent Number: 6,012,362

[45] Date of Patent: Jan. 11, 2000

[54] UTILITY PLIERS

[76] Inventor: Chao-Chi Wang, P.O. Box 63-247, Taichung, Taiwan

[21] Appl. No.: 09/064,902

[22] Filed: Apr. 23, 1998

[51] Int. Cl.[7] ..... B25B 7/12

[52] U.S. Cl. ..... 81/368; 81/380; 81/426.5

[58] Field of Search ..... 81/367–383, 426.5

[56] References Cited

U.S. PATENT DOCUMENTS

| | | | |
|---|---|---|---|
| 654,524 | 7/1900 | Descher | 81/315 |
| 2,478,696 | 8/1949 | Isele | 81/380 |
| 2,499,201 | 2/1950 | Thayer | 81/380 |
| 2,592,803 | 4/1952 | Heim | 81/368 X |
| 3,981,209 | 9/1976 | Caroff | 81/367 |
| 5,007,312 | 4/1991 | Bailey | 81/367 X |

*Primary Examiner*—D. S. Meislin
*Attorney, Agent, or Firm*—Charles E. Baxley, Esq.

[57] ABSTRACT

A utility pliers includes a first handle member with a fixed jaw secured to an end thereof, a second handle member, and a movable jaw. A connecting block includes a first part pivoted to the end of the first handle member and a second part pivoted to the second handle member. The connecting block further includes a slot defined therein. Two follower blocks are mounted to both sides of the connecting block. A pin is extended through the follower blocks and the slot of the connecting block to guide sliding movements of the follower blocks along the slot relative to the connecting block. The movable jaw is connected to the follower blocks to move therewith.

19 Claims, 7 Drawing Sheets

UTILITY PLIERS

BACKGROUND OF THE INVENTION

The present invention relates to utility pliers for fastener elements in a broad nominal size range.

FIG. 7 of the drawings illustrates a prior art utility pliers which includes a first handle member 11 having a fixed jaw 111 secured to a front end thereof and an adjusting screw 112 threadedly engaged to a rear end thereof, a second handle member 12 having a movable jaw 121 pivoted to a front end thereof and a release member 122 pivoted to a rear end thereof, a spring 13 connected between the movable jaw 121 and the first handle member 11, and an arm 14 having a first end attached to the adjusting screw 112 and a second end pivoted to the second handle member 12, the second end of the arm 14 having a protrusion 141 formed thereon. Such a utility pliers can be used on fastener elements of only one (1) to three (3) nominal sizes such that the user has to carry many utility pliers of different sizes and frequently change the utility pliers to meet various sizes of the fastener elements. A further drawback of such a utility pliers is poor gripping effect as the utility pliers engages with only two faces of the fastener element. The gripping effect is even worse when gripping a cylindrical object. The present invention is intended to provide an improved utility pliers which mitigates and/or obviates the above problems.

SUMMARY OF THE INVENTION

It is an object of the present invention to provide a utility pliers which may operate fastener elements in a broad nominal size range.

In accordance with one aspect of the invention, a utility pliers comprises a first handle member with a fixed jaw secured to an end thereof, a second handle member with a movable jaw pivoted to an end thereof, and an arm interconnected between the first handle member and the second handle member. Each of the fixed jaw and the movable jaw including a V-shaped toothed surface defined in an inner operative side thereof.

In accordance with another aspect of the invention, a utility pliers comprises:

a first handle member with a fixed jaw secured to an end thereof, a second handle member having a first end and a second end, an arm interconnected between the first handle member and the second handle member, a release member pivoted to the second end of the second handle member, a connecting block including a first part pivoted to the end of the first handle member and a second part pivoted to the first end of the second handle member, the connecting block further including a slot defined therein, two follower blocks mounted to both sides of the connecting block, a pin being extended through the follower blocks and the slot of the connecting block to guide sliding movements of the follower blocks along the slot relative to the connecting block, and a movable jaw connected to the follower blocks to move therewith.

Each of the fixed jaw and the movable jaw includes a V-shaped toothed surface.

In addition, each of the follower blocks may further include a second slot defined therein and the connecting block may include a hole. A rivet is extended through the hole of the connecting block and the second slots to guide sliding movements of the follower blocks along the second slots relative to the connecting block. The connecting block includes a stub formed thereon, and a spring is interconnected between the stub and the pin.

In an alternative design of the invention, each of the follower blocks may further include a second slot defined therein and the movable jaw includes a hole. A pin is extended through the hole of the movable jaw and the second slots to guide sliding movements of the movable jaw along the second slots relative to the follower blocks.

In a preferred embodiment of the invention, each of the follower blocks further includes a second slot and a third slot defined therein, the connecting block includes a first hole and the movable jaw includes a second hole. A rivet is extended through the first hole of the connecting block and the second slots to guide sliding movements of the follower blocks along the second slots relative to the connecting block. And a second pin is extended through the second hole of the movable jaw and the third slots to guide sliding movements of the movable jaw along the third slots relative to the follower blocks. The connecting block includes a stub formed thereon, and a first spring is interconnected between the stub and the first-mentioned pin while a second spring is interconnected between the first-mentioned pin and the second pin. Preferably, the first-mentioned slot, the second slots, and the third slots are arcuate. Preferably, each second arcuate slot is longer than each third arcuate slot.

In accordance with a further aspect of the invention, a utility pliers comprises:

a first handle member with a fixed jaw secured to an end thereof, a second handle member having a first end and a second end, an arm interconnected between the first handle member and the second handle member, a release member pivoted to the second end of the second handle member, a connecting block including a first part pivoted to the end of the first handle member and a second part pivoted to the first end of the second handle member, two follower blocks mounted to both sides of the connecting block, each of the follower blocks including a slot defined therein and the connecting block including a hole, and further comprising a rivet extended through the hole of the connecting block and the slots to guide sliding movements of the follower blocks along the second slots relative to the connecting block, and a movable jaw connected to the follower blocks to move therewith.

Each of the follower blocks further may include a second slot defined therein and the movable jaw may include a hole. A pin is extended through the hole of the movable jaw and the second slots to guide sliding movements of the movable jaw along the second slots relative to the follower blocks. The first-mentioned slots and the second slots are preferably arcuate. In addition, each first-mentioned arcuate slot is longer than each second arcuate slot. Further, each of the fixed jaw and the movable jaw includes a V-shaped toothed surface.

In accordance with still another aspect of the invention, a utility pliers comprises:

a first handle member with a fixed jaw secured to an end thereof, a second handle member having a first end and a second end, an arm interconnected between the first handle member and the second handle member, a release member pivoted to the second end of the second handle member, a connecting block including a first part pivoted to the end of the first handle member and a second part pivoted to the other end of the second handle member, a movable jaw including a hole, and two follower blocks mounted to both sides of the connecting block, each of the follower blocks including a slot defined therein, a pin extending through the hole of the movable jaw and the slots to guide sliding movements of the movable jaw along the slots relative to the follower blocks.

Each of the fixed jaw and the movable jaw may include a V-shaped toothed surface. The slots are preferably arcuate.

Other objects, advantages, and novel features of the invention will become more apparent from the following detailed description when taken in conjunction with the accompanying drawings.

DESCRIPTION OF THE PREFERRED EMBODIMENT

Figure 1:
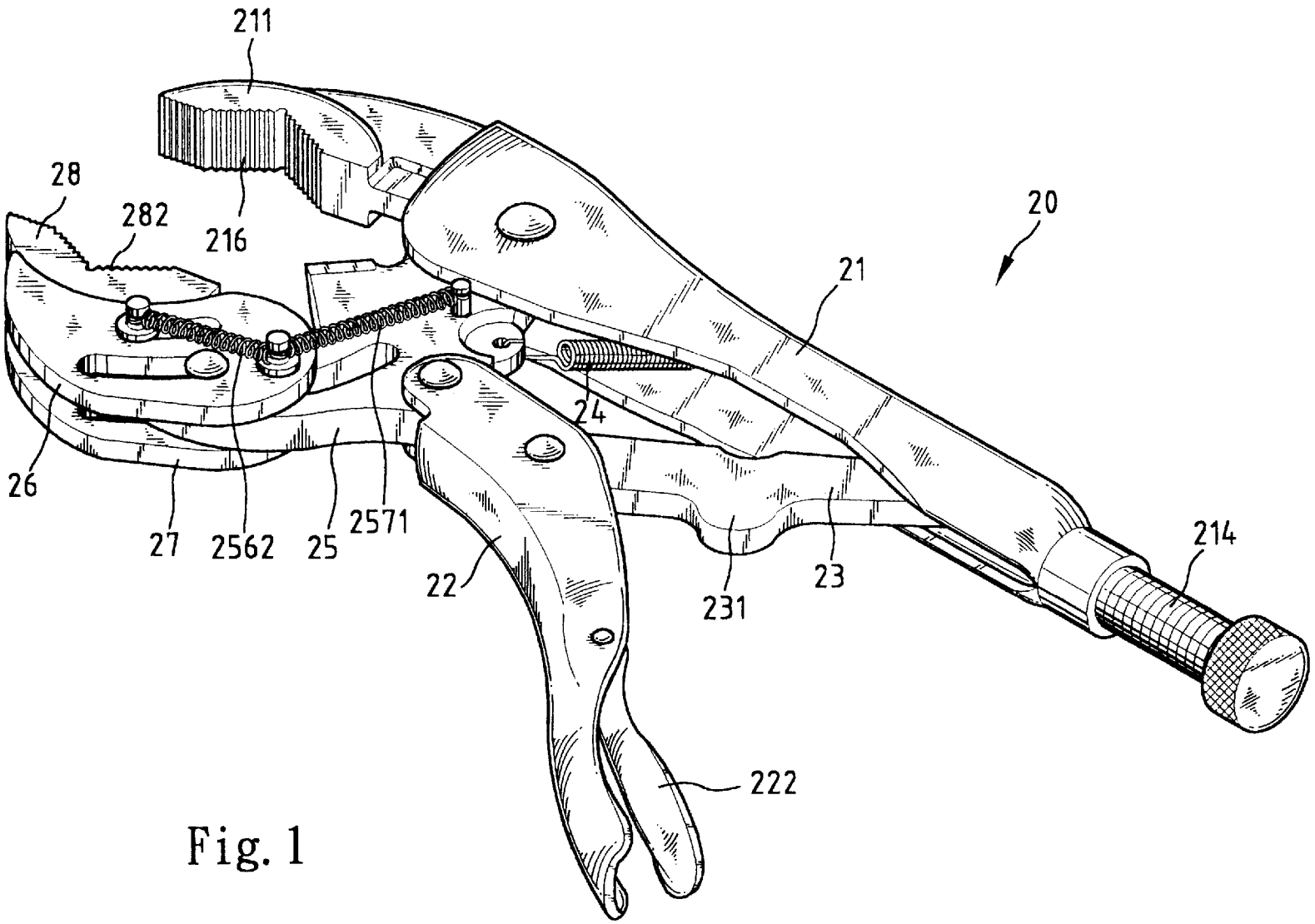
FIG. 1 is a perspective view of a utility pliers in accordance with the present invention.
Figure 2:
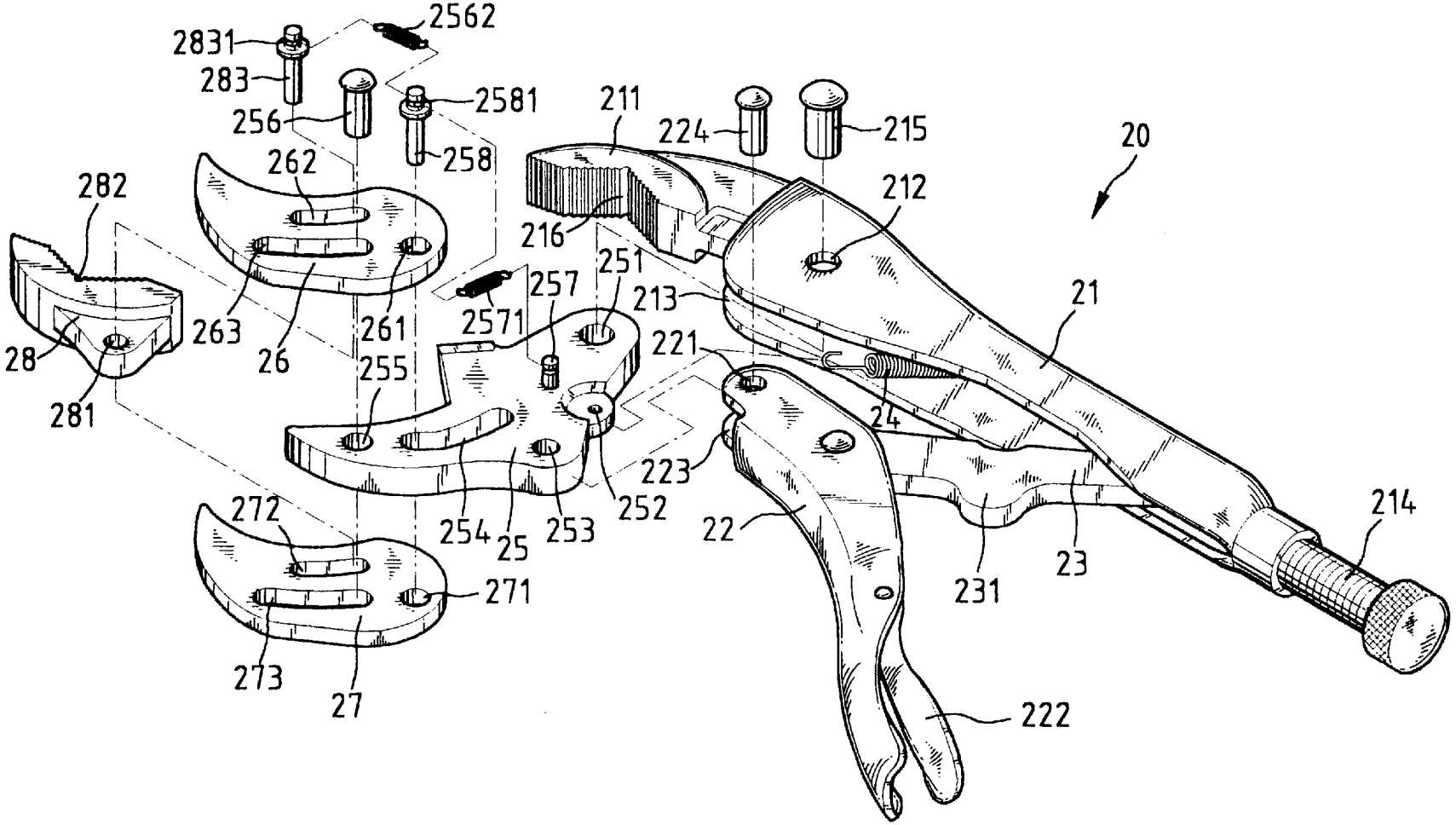
FIG. 2 is an exploded perspective view of the utility pliers in accordance with the present invention.

Referring to FIGS. 1 to 6 and initially to FIGS. 1 and 2, a utility pliers 20 in accordance with the present invention includes a first handle member 21 having a fixed jaw 211 secured to a first end thereof and an adjusting screw 214 threadedly engaged to a second end thereof, a second handle member 22 having a release member 222 pivoted thereto for releasing a fastener element gripped by the utility pliers 20, and an arm 23 having a first end connected to the adjusting screw 214, a second end pivoted to a mediate section of the second handle member 22, and a protrusion 231 formed on a mediate portion thereof. The fixed jaw 211 includes a substantially V-shaped toothed surface 216 defined in a mediate section of an inner operative side thereof. A spring 24 (e.g, a torsion spring) is received in a compartment 213 (FIG. 2) defined in the first handle member 21 and includes a first end attached to the first handle member 21. In addition, the first end of the first member 21 further includes a hole 212 defined therein, which will be described later. A first end of the second handle member 22 includes two spaced lugs (not labeled) defining a space 223 therebetween, the lugs having aligned holes 221 defined therein.

The utility pliers 20 further includes a connecting block 25 having a first part pivoted to the first handle member 21 and a second part pivoted to the second handle member 22. In this embodiment, the connecting block 25 includes holes 251, 253, and 255 to achieve the pivotal connections which will be further described later. The connecting block 25 further includes a hole 252 to which a second end of the spring 24 is attached so as to bias the first and second handle members 21 and 22 toward each other. The connecting block 25 further includes an arcuate slot 254 defined therein and a stub 257 formed on a side thereof.

The utility pliers further includes first and second follower blocks 26 and 27 respectively provided on two sides of the connecting block 25. The first follower block 26 includes a hole 261, a relatively longer arcuate slot 263, and a relatively shorter arcuate slot 262 defined therein, and the second follower block 27 also includes a hole 271, a relatively longer arcuate slot 273, and a relatively shorter arcuate slot 272. A movable jaw 28 includes a hole 281 for pivotal connection with the follower blocks 26 and 27 which will be described later. The movable jaw 28 includes a substantially V-shaped toothed surface 282 defined in a mediate section of an inner operative side thereof.

In assembly, a rivet 215 is extended through the hole 212 in the first handle member 21 and the hole 251 in the connecting block 25 to provide a pivotal connection. A rivet 224 is extended through the holes 221 in the second handle member 22 and the hole 253 in the connecting block 25 to provide a pivotal connection. Meanwhile, the other end of the spring 24 is attached to the hole 252 of the connecting block 25.

A pin 258 is extended through the hole 261 in the first follower block 26, the arcuate slot 254 in the connecting block 25, and the hole 271 in the second follower block 27 along the arcuate slot 254 to guide sliding movements of the follower blocks 26 and 27 relative to the connecting block 25. A rivet 256 is extended through the relatively longer arcuate slot 263 in the first follower block 26, the hole 255 in the connecting block 25, and the relatively longer arcuate slot 273 in the second follower block 27 to guide sliding movements of the follower blocks 26 and 27 along the relatively longer arcuate slots 263 and 273 relative to the connecting block 25. And a pin 283 is extended through the relatively shorter arcuate slot 262 in the first follower block 26, the hole 281 in the movable jaw 28, and the relatively shorter arcuate slot 272 in the second follower block 27 to guide sliding movements of the movable jaw 28 along the relatively shorter arcuate slots 262 and 272 relative to the follower blocks 26 and 27. Further, a spring 2562 is interconnected between an end 2831 of the pin 283 and an end 2581 of the pin 258 to bias the pins 283 and 258 toward each other, while a further spring 2571 is interconnected between the end 2581 of the pin 258 and an end 2571 of the stub 257 to bias the pin 258 toward the stub 257.

Figure 3:
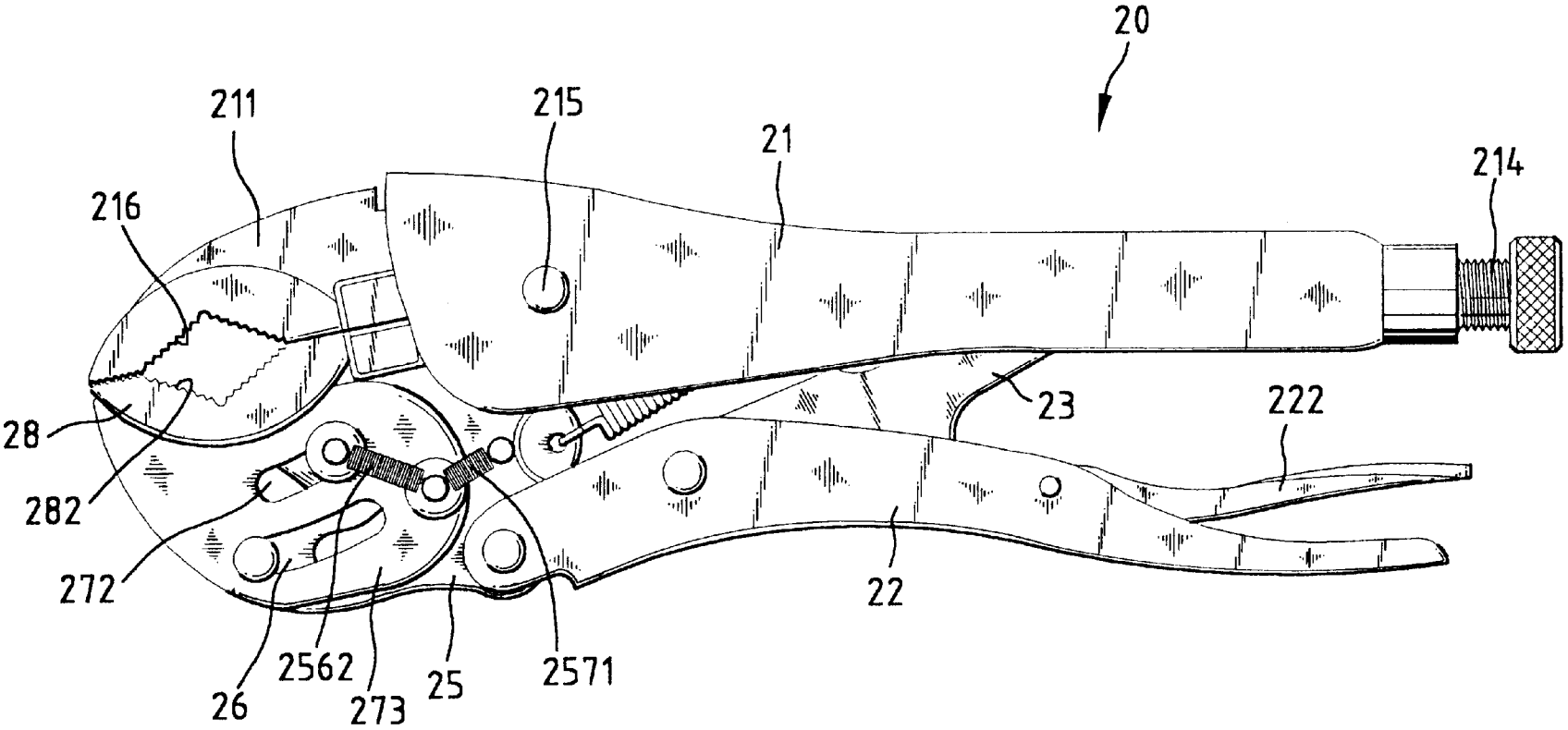
FIG. 3 is an elevational view of the utility pliers of the present invention in a closed status.
Figure 4:
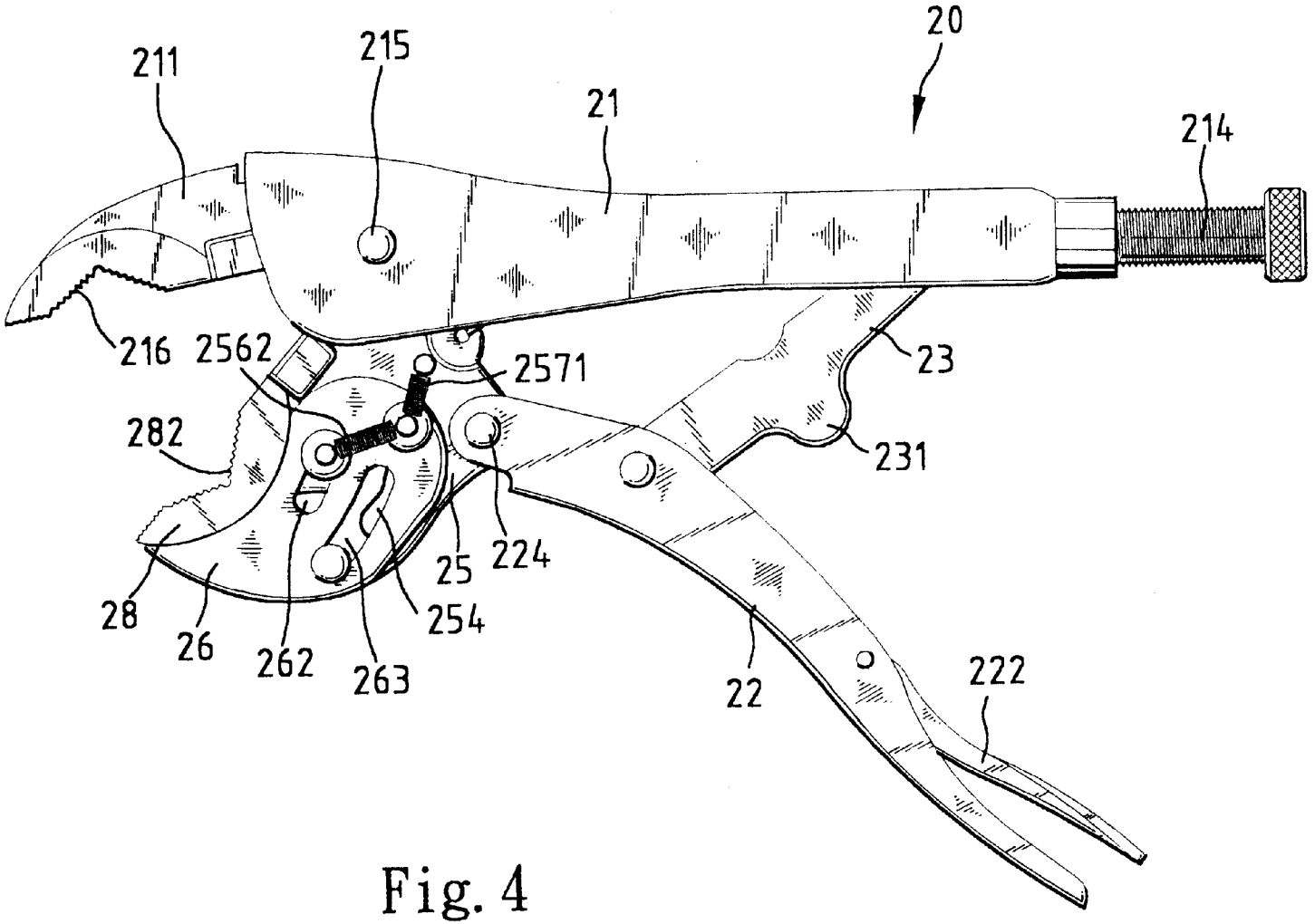
FIG. 4 is an elevational view similar to FIG. 3, wherein the utility pliers is in a fully-opened status.
Figure 5:
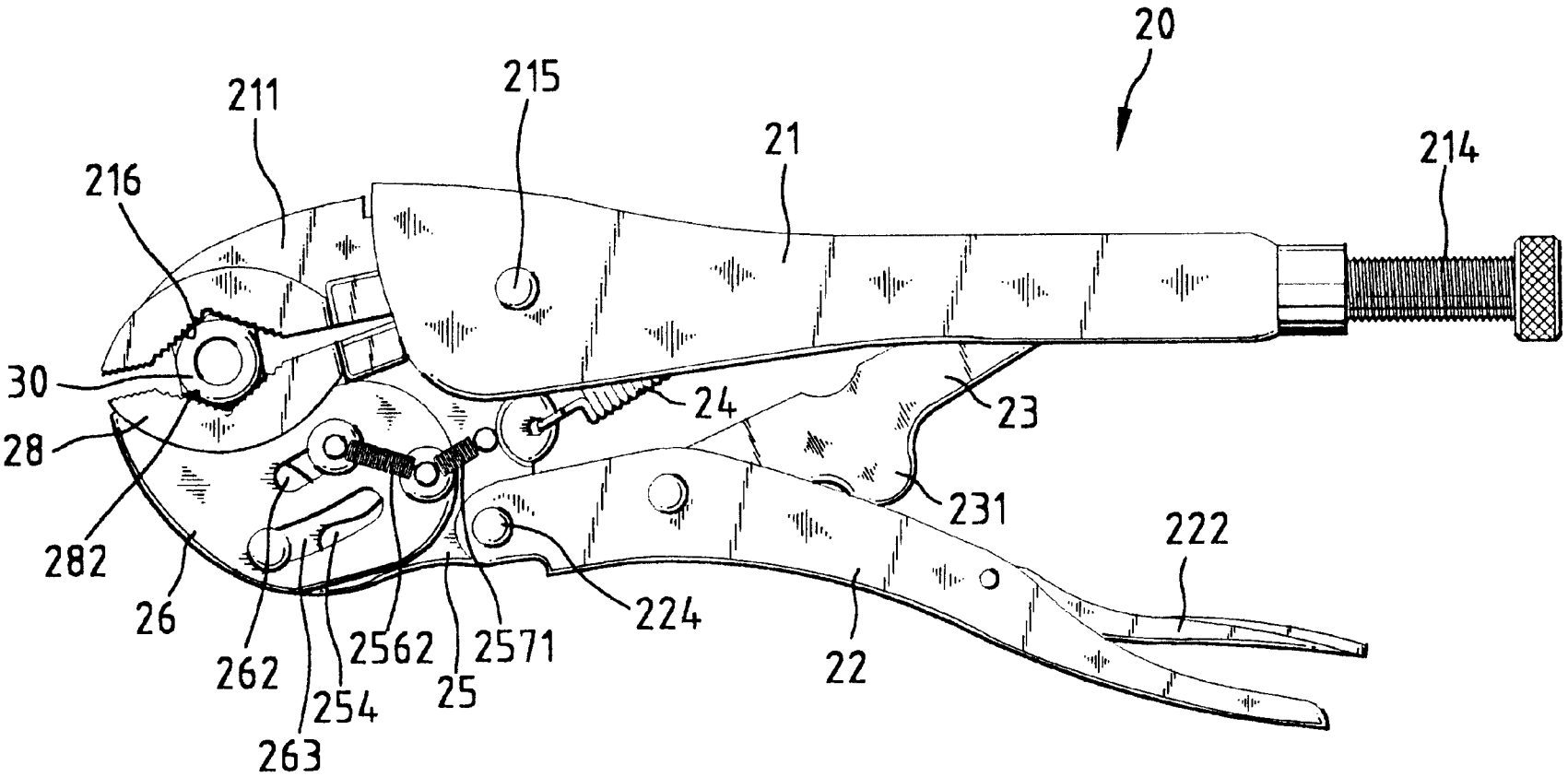
FIG. 5 is an elevational view of the utility pliers applied to a fastener element of a small nominal size.

The utility pliers in FIG. 3 is in a closed status, while the utility pliers in FIG. 4 is in a fully-opened status. In use, the utility pliers of the present invention can be applied to grip fastener elements in a broad nominal size range, i.e., the utility pliers can be applied to grip a fastener element of a relatively smaller nominal size (see FIG. 5) as well as a fastener element of a relatively larger nominal size (see FIG. 6). As a result, the user may conveniently carry very few utility pliers of various sizes. Referring to FIG. 5, when gripping a fastener element 30 of a smaller nominal size, the screw 214 is rotated to move away from the first handle member 21 (cf. FIG. 3), and a manual force is applied to the second handle member 22 after holding the utility pliers 20 in hand. The force causes extension of the springs 2571 and 2562, and, as the size of the fastener element 30 is small, the follower blocks 26 and 27 slide along the arcuate slot 254 by a small travel while the movable jaw 28 slides along the relatively shorter arcuate slots 262 and 272 of the follower blocks 26 and 27 by a small travel, such that four sides of the fastener element 30 are firmly engaged with the V-shaped toothed surfaces 216 and 282 of the fixed jaw 211 and the movable jaw 28, which is an advantage of the utility pliers of the present invention.

Figure 6:
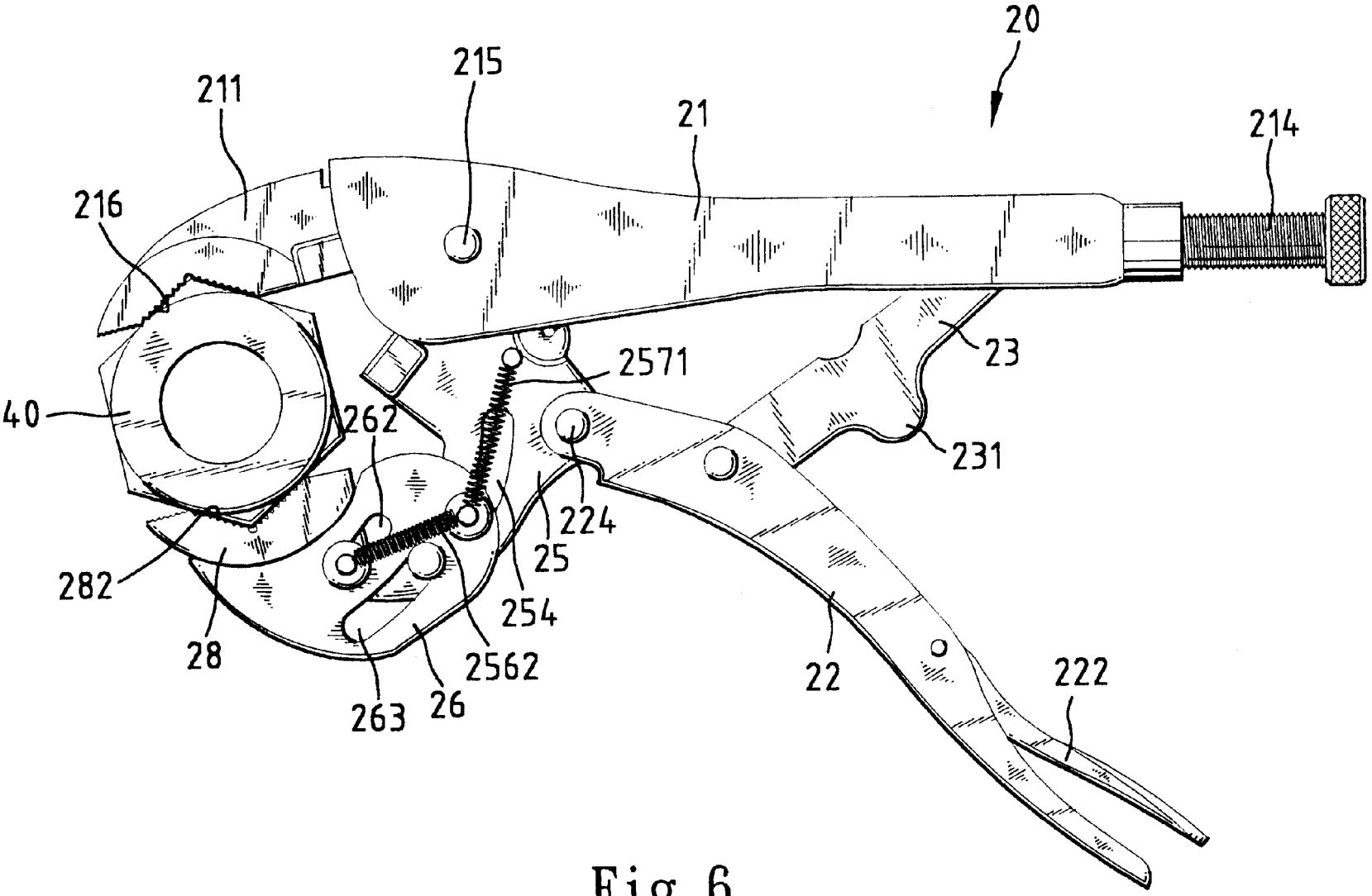
FIG. 6 is an elevational view of the utility pliers applied to a fastener element of a large nominal size.
Figure 7:
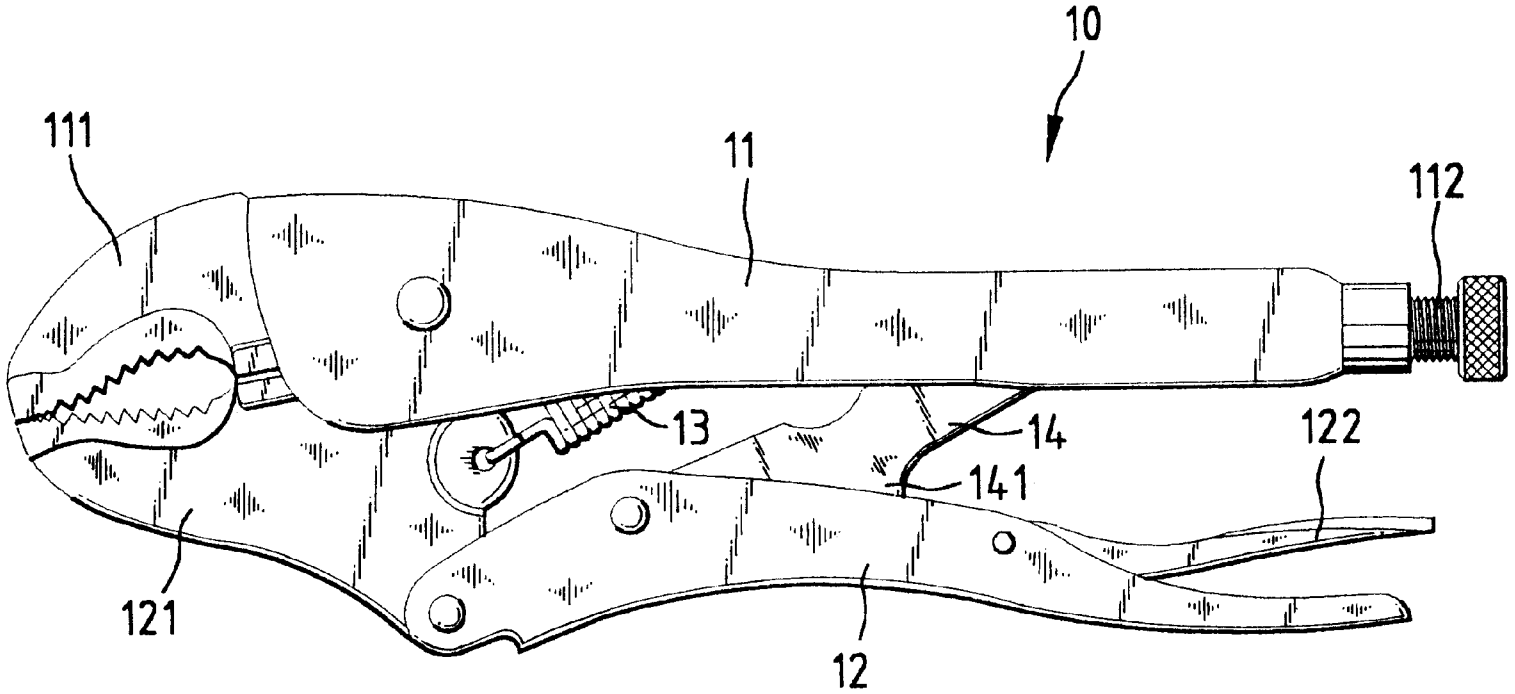
Fig. 7 PRIOR ART
FIG. 7 is an elevational view of a prior art utility pliers.

Referring to FIG. 6, when gripping a fastener element 40 of a larger nominal size, the screw 214 is rotated to move away from the first handle member 21 (cf. FIG. 3), and a force is applied to the second handle member 22 after hold the utility pliers 20 in hand. The force causes extension of the springs 2571 and 2562 in a greater extent (cf. FIG. 5), and, as the size of the fastener element 40 is larger, the follower blocks 26 and 27 slide along the arcuate slot 254 by a longer travel while the movable jaw 28 slides along the relatively shorter arcuate slots 262 and 272 of the follower blocks 26 and 27 by a longer travel until four sides of the fastener element 40 are firmly engaged with the V-shaped toothed surfaces 216 and 282 of the fixed jaw 211 and the movable jaw 28. It is appreciated that the follower blocks 26 and 27 also slides relative to the connecting blocks 25 under the guidance of the rivet 256 along the relatively longer slots 263 and 273.

According to the above description, it is appreciated that the utility pliers of the present invention is self-adjusting according to the size of the fastener element to be tightened or unfastened. In addition, each size of the utility pliers of the present invention may be applied to fastener elements in a broad nominal size range when compared with conventional utility pliers. As a result, the user may conveniently carry very few utility pliers of various sizes. Further, the fastener elements can be firmly gripped by the V-shaped toothed surfaces of the jaws of the utility pliers of the present invention.

Although the invention has been explained in relation to its preferred embodiment, it is to be understood that many other possible modifications and variations can be made without departing from the spirit and scope of the invention as hereinafter claimed.

What is claimed is:

1. A utility pliers, comprising:

a first handle member (21) with a fixed jaw (211) secured to an end thereof, a second handle member (22) having a first end and a second end, an arm (23) interconnected between the first handle member (21) and the second handle member (22), a release member (222) pivoted to the second end of the second handle member (22), a connecting block (25) including a first part (251) pivoted to the end of the first handle member and a second part (253) pivoted to the first end of the second handle member, the connecting block further including a slot (254) defined therein, two follower blocks (26, 27) respectively mounted on opposites sides of the connecting block, a pin (258) being extended through the follower blocks and the slot of the connecting block to guide sliding movements of the follower blocks along the slot relative to the connecting block, and a movable jaw (28) connected to the follower blocks to move therewith.

2. The utility pliers according to claim 1, wherein each of the fixed jaw (21) and the movable jaw (28) includes a V-shaped toothed surface (216, 282).

3. The utility pliers according to claim 1, wherein each of the follower blocks (26 and 27) further includes a second slot (263, 273) defined therein and the connecting block (25) includes a hole (255), and further comprises a rivet (256) extended through the hole (255) of the connecting block and the second slots (263, 273) to guide sliding movements of the follower blocks along the second slots, relative to the connecting block.

4. The utility block according to claim 1, wherein the connecting block (25) includes a stub (257) formed thereon, and further comprises a spring (2571) interconnected between the stub (257) and the pin (258).

5. The utility pliers according to claim 1, wherein each of the follower blocks (26 and 27) further includes a second slot (262, 272) defined therein and the movable jaw (28) includes a hole (281), and further comprises a pin (283) extended through the hole (281) of the movable jaw and the second slots (262, 272) to guide sliding movements of the movable jaw along the second slots relative to the follower blocks.

6. The utility pliers according to claim 4, wherein each of the follower blocks (26 and 27) further includes a second slot (262, 272) defined therein and the movable jaw (28) includes a hole (281), and further comprises a second pin (283) extended through the hole (281) of the movable jaw and the second slots (262, 272) to guide sliding movements of the movable jaw along the second slots relative to the follower blocks.

7. The utility pliers according to claim 6, wherein the said pin (258) and said second pin (283) includes a second spring (2562) interconnected therebetween.

8. The utility pliers according to claim 1, wherein each of the follower blocks (26 and 27) further includes a second slot (263, 273) and a third slot (262, 272) defined therein, the connecting block (25) includes a first hole (255) and the movable jaw (28) includes a second hole (281), and further comprises a rivet (256) extended through the first hole (255) of the connecting block and the second slots (263, 273) to guide sliding movements of the follower blocks along the second slots relative to the connecting block, and further comprises a second pin (283) extended through the second hole (281) of the movable jaw and the third slots (262, 272) to guide sliding movements of the movable jaw along the third slots relative to the follower blocks.

9. The utility block according to claim 8, wherein the connecting block (25) includes a stub (257) formed thereon, and further comprises:

a first spring (2571) interconnected between the stub (257) and the first-mentioned pin (258), and a second spring (2562) interconnected between the said pin (258) and said second pin (283).

10. The utility pliers according to claim 8, wherein the said slot (254), said second slots (263, 273), and the third slots (262, 272) are arcuate.

11. The utility pliers according to claim 10, wherein each said second arcuate slot (263, 273) is longer than each said third arcuate slot (262, 272).

12. A utility pliers, comprising:

a first handle member (21) with a fixed jaw (211) secured to an end thereof, a second handle member (22) having a first end and a second end, an arm (23) interconnected between the first handle member (21) and the second handle member (22), a release member (222) pivoted to the second end of the second handle member (22), a connecting block (25) including a first part (251) pivoted to the end of the first handle member and a second part (253) pivoted to the first end of the second handle member, two follower blocks (26, 27) respectively mounted on opposite sides of the connecting block, each of the follower blocks (26 and 27) including a slot (263, 273) defined therein and the connecting block (25) including a hole (255), and further comprising a rivet (256) extended through the hole (255) of the connecting block and the slots (263, 273) to guide sliding movements of the follower blocks along the second slots relative to the connecting block, and a movable jaw (28) connected to the follower blocks to move therewith.

13. The utility pliers according to claim 12, wherein each of the follower blocks (26 and 27) further includes a second slot (262, 272) defined therein and the movable jaw (28) includes a hole (281), and further comprises a pin (283) extended through the hole (281) of the movable jaw and the second slots (262, 272) to guide sliding movements of the movable jaw along the second slots relative to the follower blocks.

14. The utility pliers according to claim 13, wherein the said slots (263, 273) and said second slots (262, 272) are arcuate.

15. The utility pliers according to claim 14, wherein each said arcuate slot (263, 273) is longer than each said second arcuate slot (262, 272).

16. The utility pliers according to claim 12, each of the fixed jaw (21) and the movable jaw (28) includes a V-shaped toothed surface (216, 282).

17. A utility pliers, comprising:

a first handle member (21) with a fixed jaw (211) secured to an end thereof, a second handle member (22) having a first end and a second end, an arm (23) interconnected between the first handle member (21) and the second handle member (22), a release member (222) pivoted to the second end of the second handle member (22), a connecting block (25) including a first part (251) pivoted to the end of the first handle member and a second part (253) pivoted to said first end of the second handle member, a movable jaw (28) including a hole (281), and two follower blocks (26, 27) mounted to both sides of the connecting block, each said follower block (26, 27) including a slot (262, 272) defined therein, a pin (283) extending through the hole (281) of the movable jaw and the slots (262, 272) to guide sliding movements of the movable jaw along the slots relative to the follower blocks.

18. The utility pliers according to claim 17, each of the fixed jaw (21) and the movable jaw (28) includes a V-shaped toothed surface (216, 282).

19. The utility pliers according to claim 17, wherein the slots (262, 272) are arcuate.

* * * * *